US008955697B2

(12) United States Patent
Spilotro

(10) Patent No.: US 8,955,697 B2
(45) Date of Patent: Feb. 17, 2015

(54) FIREARM MAGAZINE STORAGE RACK

(71) Applicant: Patrick Spilotro, Lincolnshire, IL (US)

(72) Inventor: Patrick Spilotro, Lincolnshire, IL (US)

( * ) Notice: Subject to any disclaimer, the term of this patent is extended or adjusted under 35 U.S.C. 154(b) by 0 days.

(21) Appl. No.: 13/914,337

(22) Filed: Jun. 10, 2013

(65) Prior Publication Data

US 2014/0069880 A1 Mar. 13, 2014

Related U.S. Application Data

(60) Provisional application No. 61/674,892, filed on Jul. 24, 2012.

(51) Int. Cl.

| | |
|---|---|
| ***A47F 7/00*** | (2006.01) |
| ***A47B 81/00*** | (2006.01) |
| ***F42B 39/28*** | (2006.01) |
| *A47F 1/04* | (2006.01) |
| *A47F 5/00* | (2006.01) |

(52) U.S. Cl.

CPC ..... *A47B 81/00* (2013.01); *F42B 39/28* (2013.01)

USPC ..... 211/64; 211/60.1; 211/70.1; 248/309.1; D3/262

(58) Field of Classification Search

CPC ..... A47B 81/005; B60R 7/14

USPC ..... 211/49.1, 13.1, 41.12, 64, 42, 50, 60.1, 211/70.1, 70.2, 70.5, 70.6, 70.8, 70.7; 248/309.1, 316.1, 316.7, 316.8; 206/315.11, 317; 224/931, 678, 684; D6/552; D3/262

See application file for complete search history.

(56) References Cited

U.S. PATENT DOCUMENTS

| | | | | | |
|---|---|---|---|---|---|
| 299,736 | A | * | 6/1884 | Carlin | 224/678 |
| 523,052 | A | * | 7/1894 | Randle | 224/682 |
| 549,710 | A | * | 11/1895 | Evans | 224/678 |
| 560,618 | A | * | 5/1896 | Lane | 224/678 |
| 664,475 | A | * | 12/1900 | Graves | 211/70.6 |
| 1,054,487 | A | * | 2/1913 | Badley | 206/762 |
| 1,464,659 | A | * | 8/1923 | Keely | 224/247 |
| 1,951,255 | A | * | 3/1934 | Parker | 211/64 |
| 2,291,381 | A | * | 7/1942 | Drake | 248/37.6 |
| 2,472,028 | A | * | 5/1949 | Son | 422/310 |
| 2,474,763 | A | * | 6/1949 | Thomas | 211/50 |
| 2,477,806 | A | * | 8/1949 | Isaacson | 224/678 |
| 2,645,353 | A | * | 7/1953 | Anderson, Jr. | 211/70.2 |
| 2,754,008 | A | * | 7/1956 | Culver | 248/37.6 |
| 2,846,806 | A | * | 8/1958 | Gaines | 43/57.1 |
| D185,600 | S | * | 6/1959 | Gaither | D21/519 |
| 2,903,139 | A | * | 9/1959 | Penman | 211/70.1 |
| 2,905,218 | A | * | 9/1959 | Smith et al. | 206/315.11 |
| 2,919,032 | A | * | 12/1959 | Sinawski | 211/70.5 |
| 2,939,587 | A | * | 6/1960 | Kondziolka | 211/64 |
| D190,429 | S | * | 5/1961 | Hoagland | D6/552 |

(Continued)

*Primary Examiner* — Joshua J Michener
*Assistant Examiner* — Devin Barnett
(74) *Attorney, Agent, or Firm* — Robert A. Parsons; Michael W. Goltry; Parsons & Goltry

(57) ABSTRACT

A firearm magazine storage rack for holding firearm magazines is shown. The rack includes a housing having a back wall with a top edge, a bottom edge, opposing side edges and a bottom wall extending perpendicularly from the bottom edge. A plurality of bottom engagement assemblies extend from the back wall positioned proximate the top edge and a plurality of top engagement assemblies extend from the back wall positioned proximate the bottom edge. Each of the plurality of top engagement assemblies is positioned above a corresponding one of the plurality of bottom engagement assemblies with a space therebetween.

17 Claims, 3 Drawing Sheets

(56) References Cited

U.S. PATENT DOCUMENTS

| | | | | | |
|---|---|---|---|---|---|
| D198,691 | S | * | 7/1964 | Schaefer | D6/552 |
| 3,213,559 | A | * | 10/1965 | Matich | 42/89 |
| 3,537,595 | A | * | 11/1970 | Mathisen | 211/70.8 |
| D271,903 | S | * | 12/1983 | Kaufman | D24/229 |
| 4,461,385 | A | * | 7/1984 | Clouser | 211/4 |
| D286,119 | S | * | 10/1986 | Enquist | D6/552 |
| D292,957 | S | * | 12/1987 | Brussing | D6/475 |
| 4,871,074 | A | * | 10/1989 | Bryson et al. | 211/26 |
| 5,080,240 | A | * | 1/1992 | Williams | 211/70.6 |
| D324,951 | S | * | 3/1992 | Narramore | D6/552 |
| 5,209,539 | A | * | 5/1993 | Atalay | 294/143 |
| D354,988 | S | * | 1/1995 | Garza | D19/85 |
| 5,454,931 | A | * | 10/1995 | Lauve, Jr. | 206/317 |
| 5,794,799 | A | * | 8/1998 | Collins et al. | 211/70.6 |
| 5,988,382 | A | * | 11/1999 | Ritchie et al. | 206/372 |
| 6,164,463 | A | * | 12/2000 | Lee | 211/70.6 |
| 6,536,611 | B2 | * | 3/2003 | Chen | 211/70.6 |
| D477,741 | S | * | 7/2003 | Wang | D6/552 |
| D495,528 | S | * | 9/2004 | Harwanko | D6/462 |
| 7,467,719 | B2 | * | 12/2008 | Crowell et al. | 211/64 |
| D587,051 | S | * | 2/2009 | Vining | D6/552 |
| 7,815,058 | B2 | * | 10/2010 | Cheng | 211/70.6 |
| D643,658 | S | * | 8/2011 | Vining | D6/552 |
| 8,223,019 | B2 | * | 7/2012 | August et al. | 340/572.1 |
| D677,504 | S | * | 3/2013 | Childs | D6/552 |
| 8,403,278 | B1 | * | 3/2013 | Kasbohm | 248/206.5 |
| D679,329 | S | * | 4/2013 | Stravitz | D19/90 |
| D688,490 | S | * | 8/2013 | Pepe | D6/552 |
| 8,613,157 | B2 | * | 12/2013 | McCaffery | 42/99 |
| D701,584 | S | * | 3/2014 | Kasbohm | D22/108 |
| D704,474 | S | * | 5/2014 | Klein et al. | D6/552 |
| 2004/0074791 | A1 | * | 4/2004 | Lewter | 206/315.3 |
| 2006/0037920 | A1 | * | 2/2006 | Baranya | 211/70.6 |
| 2009/0255881 | A1 | * | 10/2009 | Su | 211/42 |
| 2010/0089849 | A1 | * | 4/2010 | Sheppard et al. | 211/85.7 |
| 2010/0176073 | A1 | * | 7/2010 | Dewberry et al. | 211/59.1 |
| 2012/0193254 | A1 | * | 8/2012 | Kubiniec | 206/317 |
| 2013/0002116 | A1 | * | 1/2013 | Lodge et al. | 312/351.1 |
| 2013/0118922 | A1 | * | 5/2013 | McClaughry et al. | 206/3 |
| 2014/0109455 | A1 | * | 4/2014 | Chiang | 42/90 |
| 2014/0124387 | A1 | * | 5/2014 | Iannello et al. | 206/3 |

* cited by examiner

MAGAZINE STORAGE CABINET
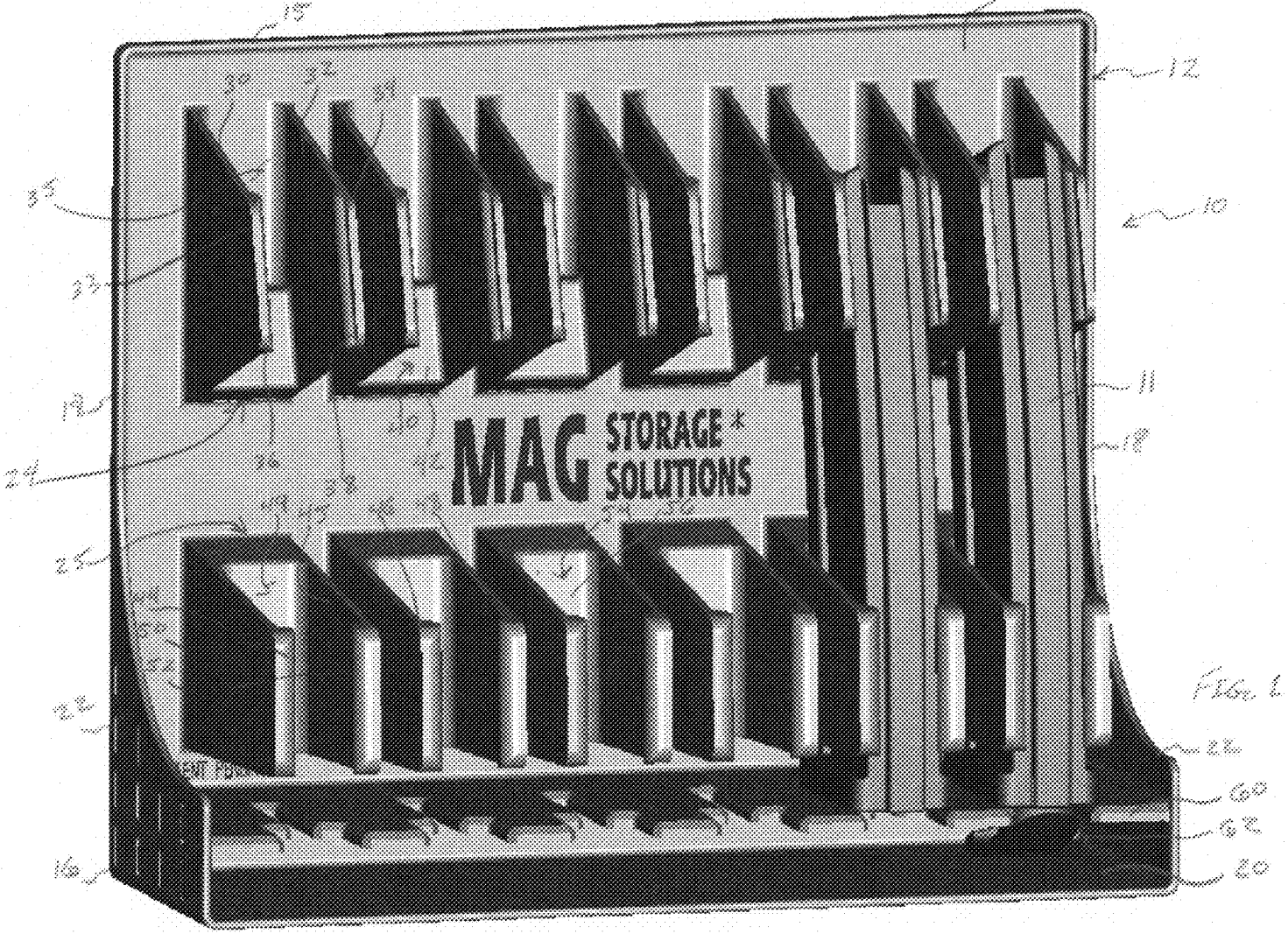

MAGAZINE STORAGE CABINET
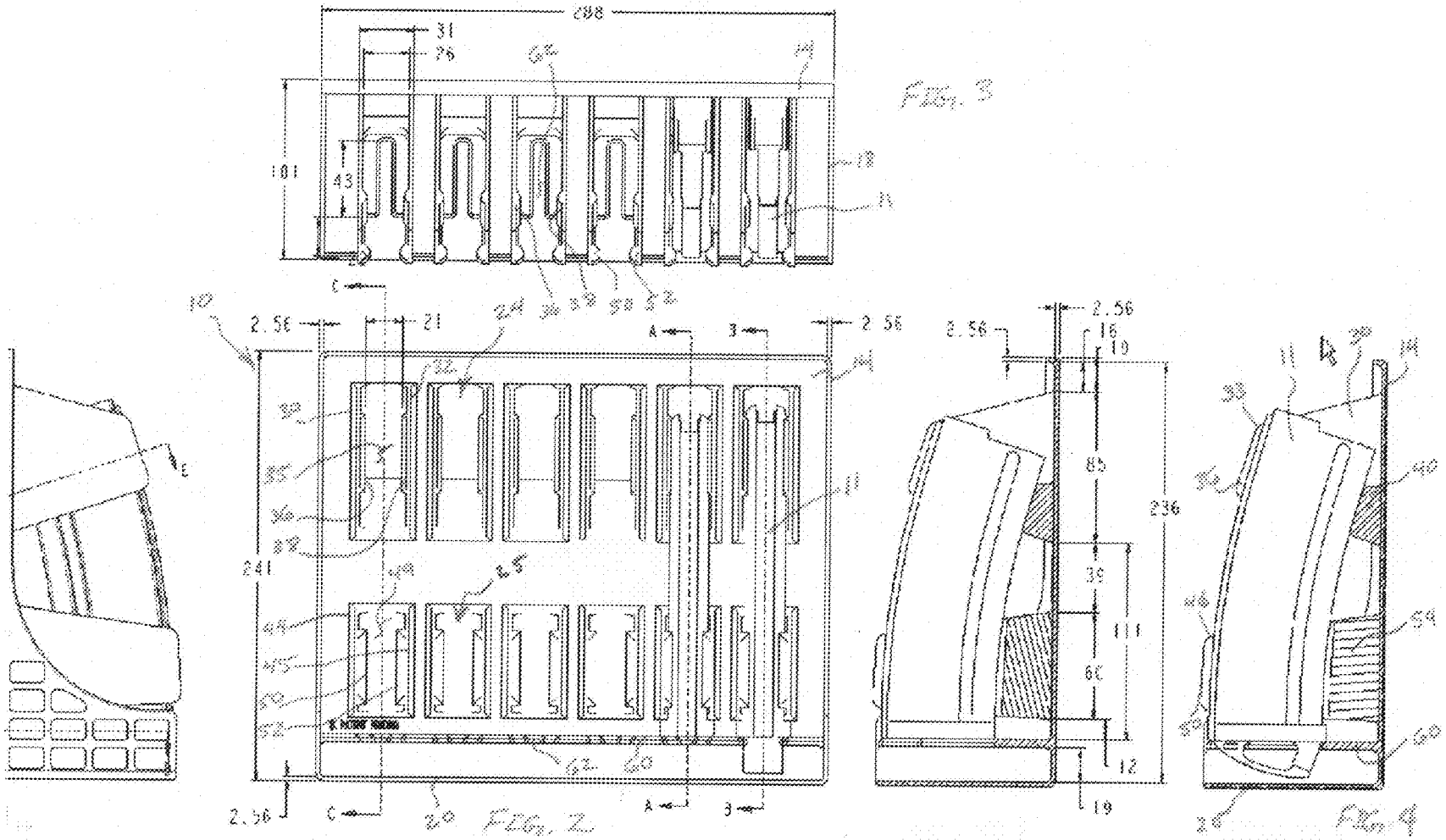

FIREARM MAGAZINE STORAGE RACK

CROSS-REFERENCE TO RELATED APPLICATION

This application claims the benefit of U.S. Provisional Patent Application No. 61/674,892, filed 24 Jul. 2012.

FIELD OF THE INVENTION

This invention relates to firearm magazines.

More particularly, the present invention relates to firearm magazine storage devices.

BACKGROUND OF THE INVENTION

In the use of firearms, an area of concern, particularly in the military and law enforcement arenas, is the storage, accounting and control of ammunition. Most ammunition, whether military or civilian, is provided in cartons carried within an ammunition box. Many firearms, semi-automatic and automatic in particular, utilize magazines for supplying rounds to the chamber of a firearm. When the magazine is exhausted, it is removed from the firearm, and replaced with a charged magazine. Often, individuals will carry multiple magazines on their persons, typically in pockets or pouches affixed to a belt and the like. However, the ammunition must be moved from "loose" rounds, as supplied in ammunition boxes, to ammunition carried by a magazine.

For civilian individuals, magazines can be charged when desired, and carried on their person. However, for military, para-military and law enforcement individuals, the availability of a charged magazine is often critical. Additionally, the organization supporting these individuals is often required to control and account for all ammunition expenditures. Thus, the organization often does not dispense the magazines until just prior to deployment. Additionally, individuals may need more available magazines then they can carry, such as during a heavy firefight or long operation. In these instances, there is a need for large storage capacity of charged magazines. This is traditionally accomplished by storing them in boxes and the like in vehicles or an arms locker. The downside to storage boxes is that the magazines are difficult to access, have the potential to be damaged, and it is difficult to account for and easily determine how many magazines have been dispensed. In civilian use, magazines are typically stored in boxes, pouches, or simply left lying around.

It would be highly advantageous, therefore, to remedy the foregoing and other deficiencies inherent in the prior art.

An object of the present invention is to provide a device for storing charged magazines.

Another object of the present invention is to provide a device for storing charged magazines that protects the magazines and allows quick and easy access.

Yet another object of the present invention is to provide a device for storing charged magazines that can be employed in vehicles, arms lockers, rooms, etc.

SUMMARY OF THE INVENTION

Briefly, to achieve the desired objects and advantages of the instant invention, provided is a firearm magazine storage rack. The rack includes a back wall with a top edge, a bottom edge, and opposing side edges, a plurality of bottom engagement assemblies, and a plurality of top engagement assemblies. The plurality of bottom engagement assemblies extend from the back wall intermediate the opposing side edges of the housing and positioned proximate the bottom edge. Each of the plurality of bottom engagement assemblies includes a first flange extending substantially perpendicularly from the back wall and terminating in a leading edge and a second flange extending substantially perpendicularly from the back wall and terminating in a leading edge. The second flange is parallel to and spaced apart from the first flange wherein the first flange and the second flange define a space therebetween. The space is sized to receive and retain a firearm magazine. A first tab extends inwardly from the leading edge of the first flange and a second tab extends inwardly from the leading edge of the second flange. The first flange and the second flange flex outwardly from a normal position to an expanded position, allowing insertion of a magazine into the space, and are biased inwardly to the normal position for securely retaining the magazine.

Each of the plurality of top engagement assemblies includes a first flange extending substantially perpendicularly from the back wall and terminating in a leading edge and a second flange extending substantially perpendicularly from the back wall and terminating in a leading edge. The second flange is parallel to and spaced apart from the first flange wherein the first flange and the second flange define a space therebetween. The space is sized to receive and retain a firearm magazine. A first tab extends inwardly from the leading edge of the first flange and a second tab extends inwardly from the leading edge of the second flange. The first flange and the second flange flex outwardly from a normal position to an expanded position, allowing insertion of a magazine into the space, and are biased inwardly to the normal position for securely retaining the magazine. Each of the plurality of top engagement assemblies is positioned above a corresponding one of the plurality of bottom engagement assemblies with a space therebetween. A mounting mechanism is provided for mounting the back wall to an upright surface.

BRIEF DESCRIPTION OF THE DRAWINGS

The foregoing and further and more specific objects and advantages of the invention will become readily apparent to those skilled in the art from the following detailed description of a preferred embodiment thereof, taken in conjunction with the drawings in which:

FIG. 1 is a front perspective view of a firearm magazine storage rack according to the present invention;

FIG. 2 is a front elevation of the firearm storage rack of FIG. 1;

FIG. 3 is a top plan view of the firearm storage rack of FIG. 1;

FIG. 4 is a sectional side view taken along line A-A of FIG. 2; and

DETAILED DESCRIPTION OF A PREFERRED EMBODIMENT

Figure 5:
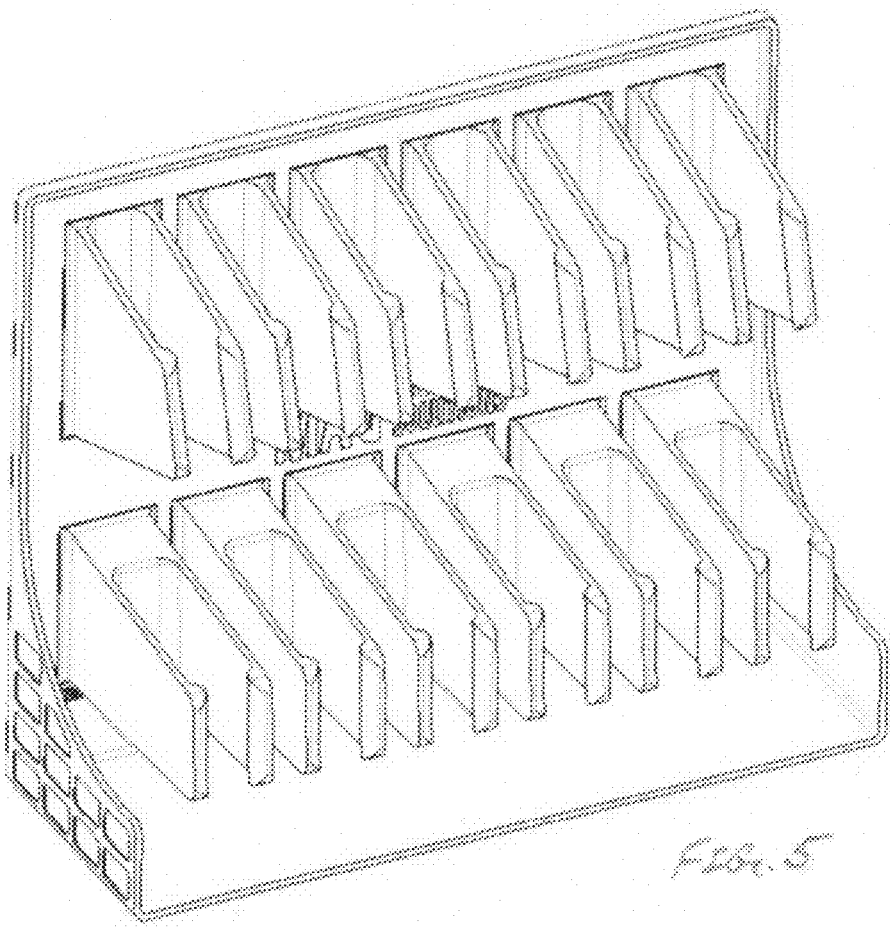
FIG. 5 is a front perspective view of another embodiment of a firearm magazine storage rack according to the present invention.

Turning now to the drawings in which like reference characters indicate corresponding elements throughout the several views, attention is directed to FIG. 1 which illustrates a firearm magazine storage rack generally designated 10. Rack 10 is intended to be mounted to an upright surface for storing firearm magazines 11. Rack 10 can store magazines of different sizes and shapes, as well as charged (filled) or uncharged. Rack 10 includes a housing 12 having a back wall 14 with a top edge 15, a bottom edge 16 and opposing side edges 18, a bottom wall 20 extending perpendicularly from bottom edge 16, and opposing partial sidewalls 22 extending perpendicularly from opposing side edges 18 and bottom wall 20. A plurality of top engagement assemblies 24 and bottom engagement assemblies 25 extend from back wall 14 intermediate sidewalls 22. Each top engagement assembly 24 is positioned above a corresponding bottom engagement assembly 25 with a space therebetween. The spacing between top engagement assemblies 24 and bottom engagement assemblies 25 facilitates insertion and removal of firearm magazines 11 therefrom. The number of top engagement assemblies 24, and bottom engagement assemblies 25 determine the number of magazines that can be stored by each rack 10. Housing 12 forms a substantially rigid structure which can be coupled to upright or vertical surfaces in buildings, vehicles, and the like. Mounting mechanisms for fixing housing 12 to a vertical surface can include screws, bolts, pins, and the like extending through apertures formed in back wall 14 and can include adhesives, welds, and the like. While rack 10 can be formed of substantially any material such as metal, rubber, plastic and the like, in the preferred embodiment, rack 10 is formed of injection molded plastic.

Still referring to FIG. 1, with additional reference to FIGS. 2 and 3, top engagement assemblies 24 each include a pair of parallel spaced apart flanges 30 and 32 extending generally perpendicularly from back wall 14 proximate top edge 15 and terminating in a leading edge 33 and 34 respectively. Flanges 30 and 32 define a space 35 therebetween, sized to receive and securely retain a firearm magazine 11. A magazine 11 is held within space 35 by tabs 36 and 38 extending inwardly from leading edges 33 and 34, respectively. Flanges 30 and 32 flex outwardly to an expanded position, widening space 35, when a magazine 11 is forced into space 35 past tabs 36 and 38. When magazine 11 is fully inserted into space 35, flanges 30 and 32 are biased inwardly to a normal position with tabs 36 and 38 engaging and securely retaining magazine 11. The bias is due to the flex in the material used and the shape memory of the material. In general, firearm magazines 11 stored by the present invention are slightly curved. A spacer block 40 extends from back wall 14 between flanges 30 and 32 of each top engagement assembly 24 and have a surface 42 sloped to match the curve of firearm magazine 11. Spacer block 40 ensures that the magazine is held firmly against tabs 36 and 38. With additional reference to FIG. 4, to further ensure engagement with firearm magazine 11, leading edges 33 and 34 are angled to generally match the curve of magazine 11. Thus, tabs 36 and 38 following the leading edges 33 and 34 are also angled and engage magazine 11 substantially along their entire length.

With reference to FIGS. 1 and 2, bottom engagement assemblies 25 each include a pair of parallel spaced apart flanges 44 and 45 extending generally perpendicularly from back wall 14 proximate bottom edge 16, and terminating in a leading edge 46 and 48, respectively. Flanges 44 and 45 define a space 49 therebetween, sized to receive and securely retain firearm magazine 11. Firearm magazine 11 is held within space 49 by tabs 50 and 52 extending inwardly from leading edges 46 and 48, respectively. Flanges 44 and 45 flex outwardly to an expanded position, widening space 49, when magazine 11 is forced into space 49 past tabs 50 and 52. When magazine 11 is fully inserted into space 49, flanges 44 and 45 return to a normal position with tabs 50 and 52 engaging and securely retaining magazine 11. In general, firearm magazines 11 stored by the present invention are slightly curved. A spacer block 54 extends from back wall 14 between flanges 44 and 45 of each bottom engagement assembly 25 and have a surface 56 sloped to generally match the curve of firearm magazine 11. Spacer block 54 ensures that the magazine is held firmly against tabs 50 and 52. With additional reference to FIG. 4, to further ensure engagement with firearm magazine 11, leading edges 46 and 48 are oriented to generally match the curve of magazine 11. Thus, tabs 50 and 52 following the leading edges 46 and 48 are also oriented to engage magazine 11 substantially along their entire length.

Firearm magazine storage rack 10 further includes a shelf 60 extending between sidewalls 22 intermediate bottom engagement assemblies 25 and bottom wall 20. Shelf 60 includes slots 62 formed therethrough and aligned under each space 49 of bottom engagement assemblies 25. Shelf 60 supports the bottom of magazines 11 while allowing extraction devices such as knobs, straps, loops and the like to extend downward through slots 62. It should be understood, however, that shelf 60 can be omitted as shown in FIG. 5, if no extraction devices are employed on the magazines.

Thus disclosed is a firearm magazine storage rack 10 capable of storing a plurality of magazines in a secure and upright manner. This permits the magazines to not only be stored in stationary locations such as building, ammunition lockers, gun safes, and the like, but also to be carried by vehicles over rough terrain while maintaining ease of access and the ability to keep track of and count individual magazines quickly and easily.

Various changes and modifications to the embodiments herein chosen for purposes of illustration will readily occur to those skilled in the art. To the extent that such modifications and variations do not depart from the spirit of the invention, they are intended to be included within the scope thereof, which is assessed only by a fair interpretation of the following claims.

Having fully described the invention in such clear and concise terms as to enable those skilled in the art to understand and practice the same, the invention claimed is:

1. A firearm magazine storage rack comprising:

a plurality of firearm magazines, each firearm magazine having an arcuately shaped front surface and an arcuately shaped back surface;

a housing having a back wall with a top edge, a bottom edge, opposing side edges and a bottom wall extending perpendicularly from the bottom edge;

a plurality of top engagement assemblies extend from the back wall intermediate the opposing side edges of the housing and positioned proximate the top edge; each of the plurality of top engagement assemblies including:

a first flange extending substantially perpendicularly from the back wall and terminating in a leading edge, the first flange having a top surface and a bottom surface, a second flange extending substantially perpendicularly from the back wall and terminating in a leading edge, the second flange having a top surface and a bottom surface, the second flange is parallel to and spaced apart from the first flange;

the first flange and the second flange define a storage space sized to receive and retain a corresponding firearm magazine;

a first tab extending inwardly from the leading edge of the first flange;

a second tab extending inwardly from the leading edge of the second flange;

the first flange and the second flange flex outwardly from a normal position to an expanded position, allowing insertion of the magazine into the space, and are biased inwardly to the normal position securely retaining the magazine; and the first leading edge and the second leading edge are each angled away from parallel toward the back wall to generally match the arcuate shape of a corresponding firearm magazine received therein, and the first tab and the second tab extending from the first leading edge and the second leading edge respectively are also each angled away from parallel toward the back wall, engaging the corresponding firearm magazine substantially along the entire length of the first tab and the second tab; wherein a corresponding firearm magazine is received and retained by a corresponding top engagement assembly so that the corresponding firearm magazine is stored in a substantially upright position.

2. A firearm magazine storage rack as claimed in claim 1, wherein each of the plurality of top engagement assemblies further comprises:

a spacer block extending from the back wall between the first flange and the second flange; wherein a surface of the spacer block is sloped to match the arcuate shape of the corresponding firearm magazine.

3. A firearm magazine storage rack as claimed in claim 1, further comprising:

a plurality of bottom engagement assemblies extending from the back wall intermediate the opposing side edges of the housing and positioned proximate the bottom edge;

wherein each of the plurality of bottom engagement assemblies comprises:

a first flange extending substantially perpendicularly from the back wall and terminating in a leading edge;

a second flange extending substantially perpendicularly from the back wall and terminating in a leading edge, the second flange parallel to and spaced apart from the first flange; and wherein the first flange and the second flange define a corresponding storage space therebetween, the corresponding storage space sized to receive and retain the corresponding firearm magazine.

4. A firearm magazine storage rack as claimed in claim 3, wherein each of the plurality of bottom engagement assemblies further comprises:

a first tab extending inwardly from the leading edge of the first flange;

a second tab extending inwardly from the leading edge of the second flange; and wherein the first flange and the second flange flex outwardly from a normal position to an expanded position, allowing insertion of the corresponding magazine into the corresponding storage space, and are biased inwardly to the normal position for securely retaining the corresponding magazine.

5. A firearm magazine storage rack as claimed in claim 4, wherein the first leading edge and the second leading edge of each of the plurality of bottom engagement assemblies are each angled away from parallel toward the back wall to generally match the arcuate shape of the corresponding magazine received therein, and the first tab and the second tab extending from the first leading edge and the second leading edge respectively are also each angled away from parallel toward the back wall, engaging the corresponding magazine substantially along the entire length of the first tab and the second tab.

6. A firearm magazine storage rack as claimed in claim 1, wherein each of the plurality of bottom engagement assemblies further comprises:

a spacer block extending from the back wall between the first flange and the second flange; wherein a surface of the spacer block is sloped to match the arcuate shape of the corresponding firearm magazine.

7. A firearm magazine storage rack as claimed in claim 1, further comprising:

opposing partial sidewalls extending perpendicularly from the opposing side edges of the back wall proximate the bottom of the housing;

a shelf extending between the opposing sidewalls intermediate the plurality of bottom engagement assemblies and the bottom wall; and the shelf including a plurality of slots formed therethrough, each of the plurality of slots aligned under a corresponding storage space defined by each of the plurality of bottom engagement assemblies.

8. A firearm magazine storage rack comprising:

a housing having a back wall with a top edge, a bottom edge, and opposing side edges;

a plurality of bottom engagement assemblies extend from the back wall intermediate the opposing side edges of the housing and positioned proximate the bottom edge, each of the plurality of bottom engagement assemblies comprising:

a first flange extending substantially perpendicularly from the back wall and terminating in a leading edge, the first flange having a top surface and a bottom surface;

a second flange extending substantially perpendicularly from the back wall and terminating in a leading edge, the second flange having a top surface and a bottom surface, the second flange parallel to and spaced apart from the first flange;

wherein the first flange and the second flange define a storage space therebetween, the storage space is sized to receive and retain a corresponding firearm magazine having an arcuately shaped front surface and an arcuately shaped back surface;

a first tab extending inwardly from the leading edge of the first flange; and a second tab extending inwardly from the leading edge of the second flange, the first flange and the second flange flex outwardly from a normal position to an expanded position, allowing insertion of the corresponding firearm magazine into the storage space, and are biased inwardly to the normal position for securely retaining the corresponding magazine in the storage space;

the top surfaces of each of the plurality of bottom engagement assemblies are each sloped downwardly at an angled, the first leading edge and the second leading edge of each of the plurality of bottom engagement assemblies are each angled to generally match the arcuate shaped of the corresponding magazine to be received therein, and the first tab and the second tab extending from the first leading edge and the second leading edge respectively are also each angled for engaging the corresponding magazine substantially along the entire length of the first tab and the second tab;

a plurality of top engagement assemblies extend from the back wall intermediate the opposing side edges of the housing and positioned proximate the top edge, each of the plurality of top engagement assemblies comprising:

a first flange extending substantially perpendicularly from the back wall and terminating in a leading edge, the first flange having a top surface and a bottom surface;

a second flange extending substantially perpendicularly from the back wall and terminating in a leading edge, the second flange having a top surface and a bottom surface, the second flange parallel to and spaced apart from the first flange;

wherein the first flange and the second flange define a corresponding storage space therebetween, the corresponding storage space is sized to receive and retain the corresponding firearm magazine having an arcuately shaped front surface and an arcuately shaped back surface;

a first tab extending inwardly from the leading edge of the first flange; and a second tab extending inwardly from the leading edge of the second flange, the first flange and the second flange flex outwardly from a normal position to an expanded position, allowing insertion of the corresponding firearm magazine into the corresponding storage space, and are biased inwardly to the normal position for securely retaining the corresponding magazine in the corresponding storage space;

the bottom surfaces of each of the plurality of top engagement assemblies are each sloped upwardly at an angled, the first leading edge and the second leading edge of each of the plurality of top engagement assemblies are each angled away from parallel toward the back wall to generally match the arcuate shape of the corresponding magazine to be received therein, and the first tab and the second tab extending from the first leading edge and the second leading edge respectively are also each angled away from parallel toward the back wall for engaging the corresponding magazine substantially along the entire length of the first tab and the second tab;

wherein each of the plurality of top engagement assemblies is positioned above a corresponding one of the plurality of bottom engagement assemblies with a space therebetween; and a mounting mechanism for mounting the back wall to an upright surface.

9. A firearm magazine storage rack as claimed in claim 8, wherein each of the plurality of top engagement assemblies further comprises:

a spacer block extending from the back wall between the first flange and the second flange; wherein a surface of the spacer block is sloped to match the arcuate shape of the corresponding firearm magazine.

10. A firearm magazine storage rack as claimed in claim 8, wherein each of the plurality of bottom engagement assemblies further comprises:

a spacer block extending from the back wall between the first flange and the second flange; wherein a surface of the spacer block is sloped to match the arcuate shape of the corresponding firearm magazine.

11. A firearm magazine storage rack as claimed in claim 8, further comprising:

a shelf extending from the back wall between the opposing side edges and intermediate the plurality of bottom engagement assemblies and the bottom edge of the housing; and the shelf including a plurality of slots formed therethrough, each of the plurality of slots aligned under a different one of the storage spaces of the plurality of bottom engagement assemblies.

12. A firearm magazine storage rack comprising:

at least one firearm magazine, each firearm magazine having a curved front surface and a curved back surface;

a back wall with a top edge, a bottom edge, and opposing side edges;

a plurality of bottom engagement assemblies extend from the back wall intermediate the opposing side edges of the housing and positioned proximate the bottom edge, each of the plurality of bottom engagement assemblies comprising:

a first flange extending substantially perpendicularly from the back wall and terminating in a leading edge;

a second flange extending substantially perpendicularly from the back wall and terminating in a leading edge, the second flange parallel to and spaced apart from the first flange;

wherein the first flange and the second flange define a storage space therebetween, the storage space receiving and retaining a corresponding firearm magazine;

a first tab extending inwardly from the leading edge of the first flange;

a second tab extending inwardly from the leading edge of the second flange, the first flange and the second flange flex outwardly from a normal position to an expanded position, allowing insertion of the corresponding magazine into the storage space, and are biased inwardly to the normal position for securely retaining the corresponding magazine in the storage space;

a plurality of top engagement assemblies extend from the back wall intermediate the opposing side edges of the housing and positioned proximate the top edge, each of the plurality of top engagement assemblies comprising:

a first flange extending substantially perpendicularly from the back wall and terminating in a leading edge;

a second flange extending substantially perpendicularly from the back wall and terminating in a leading edge, the second flange parallel to and spaced apart from the first flange with the first flange and the second flange defining a corresponding storage space therebetween, the corresponding storage space sized to receive and retain the corresponding firearm magazine;

wherein the corresponding firearm magazine received and retained by a correspondingly aligned bottom engagement assembly is received and retained by the corresponding storage space of the corresponding top engagement assembly;

a first tab extending inwardly from the leading edge of the first flange; and a second tab extending inwardly from the leading edge of the second flange, the first flange and the second flange flex outwardly from a normal position to an expanded position, allowing insertion of the corresponding magazine into the corresponding storage space, and are biased inwardly to the normal position securely retaining the corresponding magazine in the corresponding storage space;

wherein each of the plurality of top engagement assemblies is positioned above a corresponding one of the plurality of bottom engagement assemblies with a space therebetween; and a mounting mechanism for mounting the back wall to an upright surface.

13. A firearm magazine storage rack as claimed in claim 12, wherein the first leading edge and the second leading edge of each of the plurality of top engagement assemblies are angled to generally match the curve of the back surface of the corresponding firearm magazine, and the first tab and the second tab of each of the plurality of top engagement assemblies extending from the first leading edge and the second leading edge respectively are also angled for engaging the back surface of the corresponding firearm magazine.

14. A firearm magazine storage rack as claimed in claim 13, wherein each of the plurality of top engagement assemblies further comprises:

a spacer block extending from the back wall between the first flange and the second flange; wherein a surface of the spacer block is sloped to accommodate the curve of the front surface of the corresponding firearm magazine.

15. A firearm magazine storage rack as claimed in claim 12, wherein the first leading edge and the second leading edge of each of the plurality of bottom engagement assemblies are angled to generally match the curve of the back surface of the corresponding firearm magazine, and the first tab and the second tab of each of the plurality of bottom engagement assemblies extending from the first leading edge and the second leading edge respectively are also angled for engaging the back surface of the corresponding firearm magazine.

16. A firearm magazine storage rack as claimed in claim 15, wherein each of the plurality of bottom engagement assemblies further comprises:

a spacer block extending from the back wall between the first flange and the second flange; wherein a surface of the spacer block is sloped to accommodate the curve of the front surface of the corresponding firearm magazine.

17. A firearm magazine storage rack as claimed in claim 12, further comprising:

a shelf extending from the back wall between the opposing side edges and intermediate the plurality of bottom engagement assemblies and the bottom edge; and the shelf including a plurality of slots formed therethrough, each of the plurality of slots aligned under a different one of the storage spaces of the plurality of bottom engagement assemblies to accommodate projections from the bottom of the corresponding firearm magazine.

* * * * *